US006716075B2

(12) United States Patent
Fuse et al.

(10) Patent No.: US 6,716,075 B2
(45) Date of Patent: Apr. 6, 2004

(54) STEERING NOZZLE ANGLE ADJUSTING MECHANISM FOR JET PROPULSION WATERCRAFT

(75) Inventors: Tomohiro Fuse, Saitama (JP); Yoshiaki Noda, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/216,897

(22) Filed: Aug. 13, 2002

(65) Prior Publication Data

US 2003/0068934 A1 Apr. 10, 2003

(30) Foreign Application Priority Data

Sep. 18, 2001 (JP) ..... 2001-282745

(51) Int. Cl.[7] ..... B63H 11/113
(52) U.S. Cl. ..... 440/42
(58) Field of Search ..... 440/40, 41, 42, 440/47; 114/144 R, 284

(56) References Cited

U.S. PATENT DOCUMENTS 3,266,733 A * 8/1966 Goehler ..... 440/41
3,776,173 A * 12/1973 Horwitz ..... 440/42
3,834,342 A * 9/1974 Schoell ..... 440/41
5,062,815 A * 11/1991 Kobayashi ..... 440/41
5,154,650 A * 10/1992 Nakase ..... 440/41
5,551,898 A * 9/1996 Matsumoto ..... 440/41
5,803,775 A * 9/1998 Henmi ..... 440/42
6,102,756 A * 8/2000 Michel et al. ..... 440/42
6,146,219 A * 11/2000 Blanchard ..... 440/40
6,174,210 B1 * 1/2001 Spade et al. ..... 440/41

FOREIGN PATENT DOCUMENTS

JP 09-048394 2/1997

* cited by examiner

*Primary Examiner*—S. Joseph Morano
*Assistant Examiner*—Lars A. Olson
(74) *Attorney, Agent, or Firm*—Birch, Stewart, Kolasch & Birch, LLP

(57) ABSTRACT

To provide a steering nozzle angle adjusting mechanism for a jet propulsion watercraft in which an adjustment of the angle of a steering nozzle can be easily carried out without much labor. A steering nozzle angle adjusting mechanism includes at a rear end of an operational cable a screw-connection to a neck portion of a joint. A fitting rod is fixed to an arm of a steering nozzle with a through-hole of the joint fitted over the fitting rod. The joint is fixed by a nut wherein the nut is locked by a lock nut. The lock nut is screwed onto the nut to thereby prevent the nut from loosening.

5 Claims, 9 Drawing Sheets

STEERING NOZZLE ANGLE ADJUSTING MECHANISM FOR JET PROPULSION WATERCRAFT

CROSS-REFERENCE TO RELATED APPLICATIONS

The present application claims priority under 35 USC 119 to Japanese Patent Application No. 2001-282745 filed on Sep. 18, 2001 the entire contents thereof is hereby incorporated by reference.

BACKGROUND OF THE INVENTION

1. Field of the Invention

The present invention relates to a steering nozzle angle adjusting mechanism for a jet propulsion watercraft wherein a steering nozzle is provided in addition to a jet nozzle at the stem and the steering nozzle is swung to the left and right by use of an operational cable.

2. Description of Background Art

A jet propulsion watercraft is disclosed in Japanese Patent Laid-open No. Hei 9-48394 "Propulsion Nozzle Driving Device and Input/Output Conversion Mechanism for Small Watercraft Device". A part of FIG. 1 shown in the publication is illustrated in the following FIGS. 9 and 10. The numerals set forth in FIGS. 9 and 10 have been changed for the purpose of the present description.

FIG. 9 is a side view of a propulsion nozzle provided in a conventional jet propulsion watercraft. The jet propulsion watercraft 100 comprises a jet propeller 101 at the stem, and a propulsion nozzle 102 provided on the rear side of the jet propeller 101 so as to be vertically swingable on left and right support shafts 103, 103. By driving the jet propeller 101, water is jetted from an outlet 102*a* of the propulsion nozzle 102, and the jet propulsion watercraft 100 is propelled by utilizing the jet force of water.

An operational cable 105 is connected to the propulsion nozzle 102 through a joint 104, whereby the direction of the propulsion nozzle 102 can be vertically changed by the operational cable 105.

Thus, by changing the direction of the propulsion nozzle 102, the posture of the watercraft body of the jet propulsion watercraft 100 can be maintained favorably according to the propulsion conditions.

Here, the joint 104 for connecting the operational cable 105 to the propulsion nozzle 102 generally has a construction in which a spherical body 106*a* of a fitting rod 106 is rotatably fitted to a head portion 104*a*, and a neck portion 104*b* is provided with a female screw (not shown).

In connecting the operational cable 105 to the propulsion nozzle 102 by use of the joint 104, first, a male screw provided at the rear end of the operational cable 105 is coupled to the female screw of the neck portion 104*b*. At this time, the protrusion amount of the joint 105 relative to the operational cable 105 is adjusted to be appropriate.

Next, the fitting rod 106 fitted to the head portion 104*a* through the spherical body 106*a* is inserted into a through-hole in the propulsion nozzle 102, and the tip end of the fitting rod 106 projects to the inner circumferential side of the propulsion nozzle 102. Subsequently, a nut 107 is screw-connected to the tip end of the fitting rod 106 thus projected, so as to fix the fitting rod 106 to the propulsion nozzle 102, thereby connecting the operational cable 105 to the propulsion nozzle 102.

After the operational cable 105 is connected to the propulsion nozzle 102, it is determined whether or not the propulsion nozzle 102 is fitted at a normal angle. When the propulsion nozzle 102 is not directed in a normal direction, the nut 107 is disengaged from the fitting rod 106, and the joint 104 is detached from the propulsion nozzle 102.

Subsequently, the joint 104 detached from the propulsion nozzle 102 is rotated relative to the operational cable 105, whereby the amount of projection of the joint 104 relative to the operational cable 105 is readjusted.

After the readjustment is completed, the fitting rod 106 is again inserted into the through-hole in the propulsion nozzle 102, and the nut 107 is screw-connected to the tip end of the fitting rod 106 projecting to the inner circumference side of the propulsion nozzle 102, whereby the fitting rod 106 is again fixed to the propulsion nozzle 102.

In this condition, it is again checked whether or not the propulsion nozzle 102 is fitted at the normal angle. When the propulsion nozzle 102 is fitted at the normal angle, the operational of connecting the operational cable 105 to the propulsion nozzle 102 is completed.

Thus, in order to readjust the angle of the propulsion nozzle 102 to a normal condition after connection of the operational cable 105 to the propulsion nozzle 102, it is necessary to disengage from the fitting rod 106 the nut 107 which has once been screw-connected to the fitting rod 106. Therefore, the operational of adjusting the direction of the propulsion nozzle 102 to the normal angle requires much labor.

FIG. 10 is a side view showing another joint for connecting a cable to a conventional propulsion nozzle. According to the joint 110, a fitting bolt 111 is inserted into a through-hole in a head portion 110*a*, and the tip end 111*a* of the fitting bolt 111 inserted in the through-hole is screw-connected to a propulsion nozzle 113, whereby an operational cable 105 can be connected to the propulsion nozzle 113.

Also in the case of using the joint 110, in order to readjust the direction of the propulsion nozzle 113 to a normal position after connection of the operational cable 105 to the propulsion nozzle 113, it is necessary to disengage from the propulsion nozzle 113 the fitting bolt 111 which has once been screw-connected to the propulsion nozzle 113.

Therefore, the operation of adjusting the direction of the propulsion nozzle 113 to the normal angle requires much labor, in the same manner as in the case of FIG. 9.

While examples of swinging the propulsion nozzle 102, 113 vertically have been described in the cases of FIGS. 9 and 10, some jet propulsion watercrafts adopt the system in which the propulsion nozzle is fitted swingably in left-right directions and the watercraft body is turned to the left and right by changing the direction of the propulsion nozzle (hereinafter referred to as "steering nozzle") to the left and right directions by an operational cable.

Also in the case of connecting the operational cable to the steering nozzle, the same inconvenience as that described referring to FIGS. 9 and 10 is experienced.

SUMMARY AND OBJECTS OF THE INVENTION

Accordingly, it is an object of the present invention to provide a steering nozzle angle adjusting mechanism for a jet propulsion watercraft wherein an adjustment of the angle of the steering nozzle can be easily carried out without requiring much labor.

In order to solve the above-mentioned problems, the present invention is directed to a propulsion watercraft wherein a jet nozzle for jetting water is provided at the stern, a steering nozzle is provided in addition to the jet nozzle, and the steering nozzle is swung to the left and right by use of an operational cable to change the direction of a jet from the jet nozzle for steering the watercraft. A fitting rod is fitted to the steering nozzle side with a joint turnably supported on the fitting rod so that the joint can be fitted to and detached from the fitting rod. The operational cable can be connected to the joint and the cable length at the time when the operational cable is connected to the joint can be adjusted.

The fitting rod is fitted to the steering nozzle side, and the joint can be turnably supported on the fitting rod so that the joint can be fitted to and detached from the fitting rod, whereby the operational cable can be tentatively fixed to the steering nozzle by only fitting the joint to the fitting rod. In this way, with the condition where the joint is tentatively fixed by only fitting to the fitting rod, it can be determined and checked whether or not the angle of the steering nozzle is normal.

Therefore, even in the case where it is necessary to readjust the angle of the steering nozzle, the joint can be easily detached from the fitting rod.

The present invention includes a jet propulsion watercraft of the system in which a jet nozzle for jetting water is provided at the stern, a steering nozzle is provided additionally to the jet nozzle, and the steering nozzle is swung to the left and right by use of an operational cable to change the direction of a jet from the jet nozzle for thereby steering. The jet nozzle and the steering nozzle are each provided with positioning projections or positioning recesses for the steering nozzle on both sides of a support shaft for swingably supporting the steering nozzle on the jet nozzle.

Prior to the present invention, when the steering nozzle is mounted onto the jet nozzle, it is necessary to check whether or not the steering nozzle is disposed at a normal angle, and the check has hitherto been performed relying on the operator's sense. Therefore, disposition of the steering nozzle at the normal angle has required skill.

In view of the above, in the present invention the jet nozzle and the steering nozzle are each provided with positioning projections or positioning recesses for the steering nozzle. By this, for example, by using the projection on the steering nozzle and the projection on the jet nozzle as marks and measuring the distance between the projections, it is possible to dispose the steering nozzle at the normal angle without requiring a great deal of skill.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
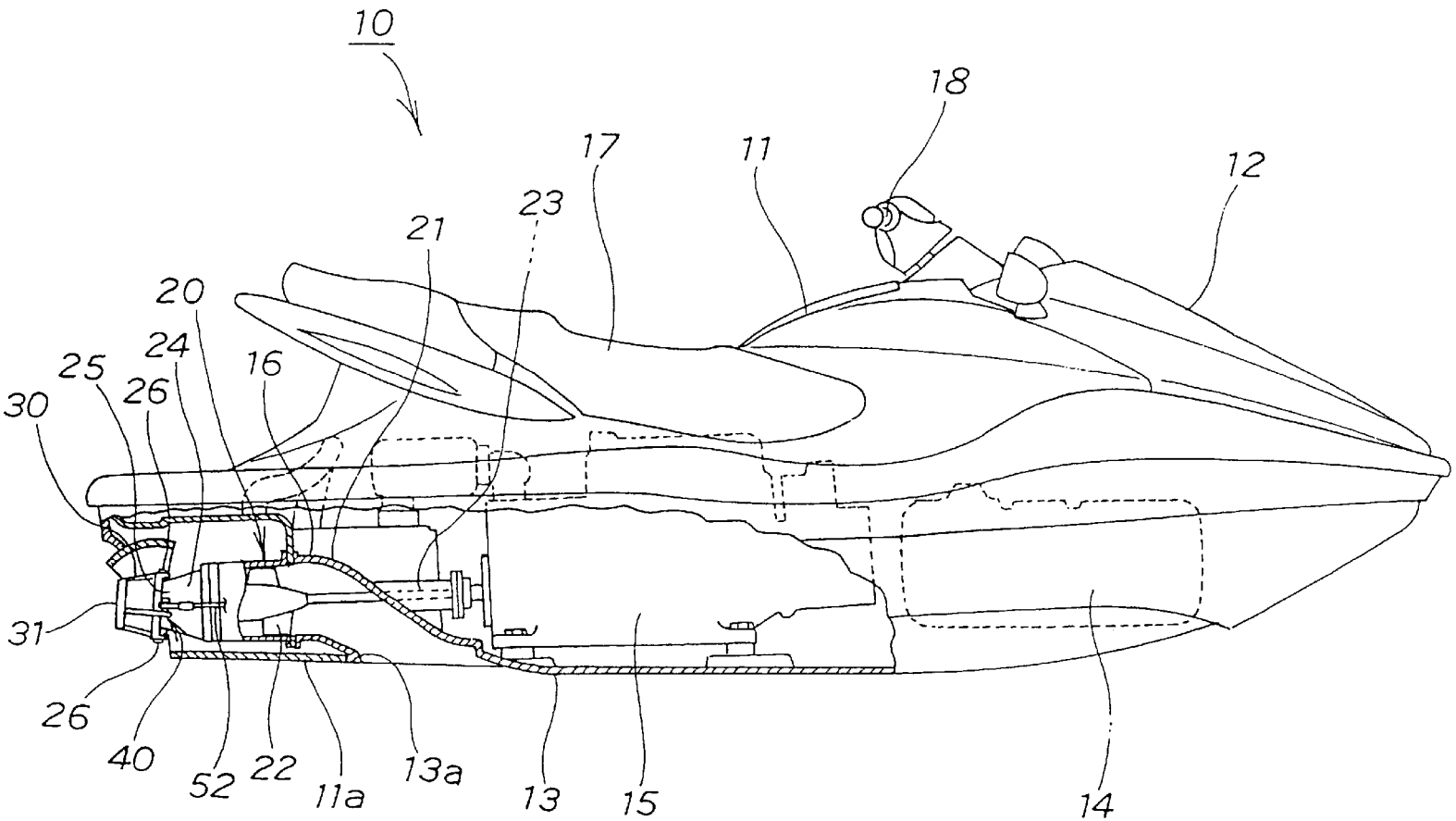
FIG. 1 is a side view of a jet propulsion watercraft provided with a steering nozzle angle adjusting mechanism according to the present invention.

A mode for carrying out the present invention will be described below based on the accompanying drawings. FIG. 1 is a side view of a jet propulsion watercraft provided with a steering nozzle angle adjusting mechanism according to the present invention.

The jet propulsion watercraft 10 includes a fuel tank 14 that is fitted to a front portion 12 of a watercraft body 11. An engine 15 is provided on the rear side of the fuel tank 14. A jet propeller chamber 16 is provided on the rear side of the engine 15 with a jet propeller 20 provided in the jet propeller chamber 16 at the stern 11*a* and a steering nozzle 30 provided on the rear side of the jet propeller 20. A steering nozzle angle adjusting mechanism 40 is provided for adjusting the angle of the steering nozzle 30 and being capable of disposing the steering nozzle 30 at a normal angle. An operational cable 52 is connected to the steering nozzle 30 through the steering nozzle angle adjusting mechanism 40. A steering handle 18 for operating the operational cable 52 is fitted to the upper side of the fuel tank 14 with a seat 17 provided on the rear side of the steering handle 18.

The jet propeller 20 has a structure in which a housing 21 extends rearwardly from an intake port 13*a* at a watercraft bottom 13. An impeller 22 is rotatably fitted in the housing 21 with the impeller 22 being connected to a driving shaft 23 of the engine 15 (shown in FIG. 1).

According to the jet propulsion watercraft 10 constituted as above, the engine 15 is driven by supplying fuel from the fuel tank 14 to the engine 15. The driving force of the engine 15 is transmitted through the driving shaft 23 to the impeller 22, and the impeller 22 is thereby rotated, whereby water is taken in through the intake port 13*a* at the watercraft bottom 13. The water thus taken in is passed through the rear end of the housing 21, namely, an outlet 25 of a joint nozzle 24 to be jetted as jet water from an outlet 31 of the steering nozzle 30, whereby jet propulsion is achieved.

In this case, by operating the operational cable 52 by the steering handle 18 so as to swing the steering nozzle 30 to the left or right direction with upper and lower support shafts 26, 26 as a center, the watercraft body 11 can be turned to the left or right.

Figure 2:
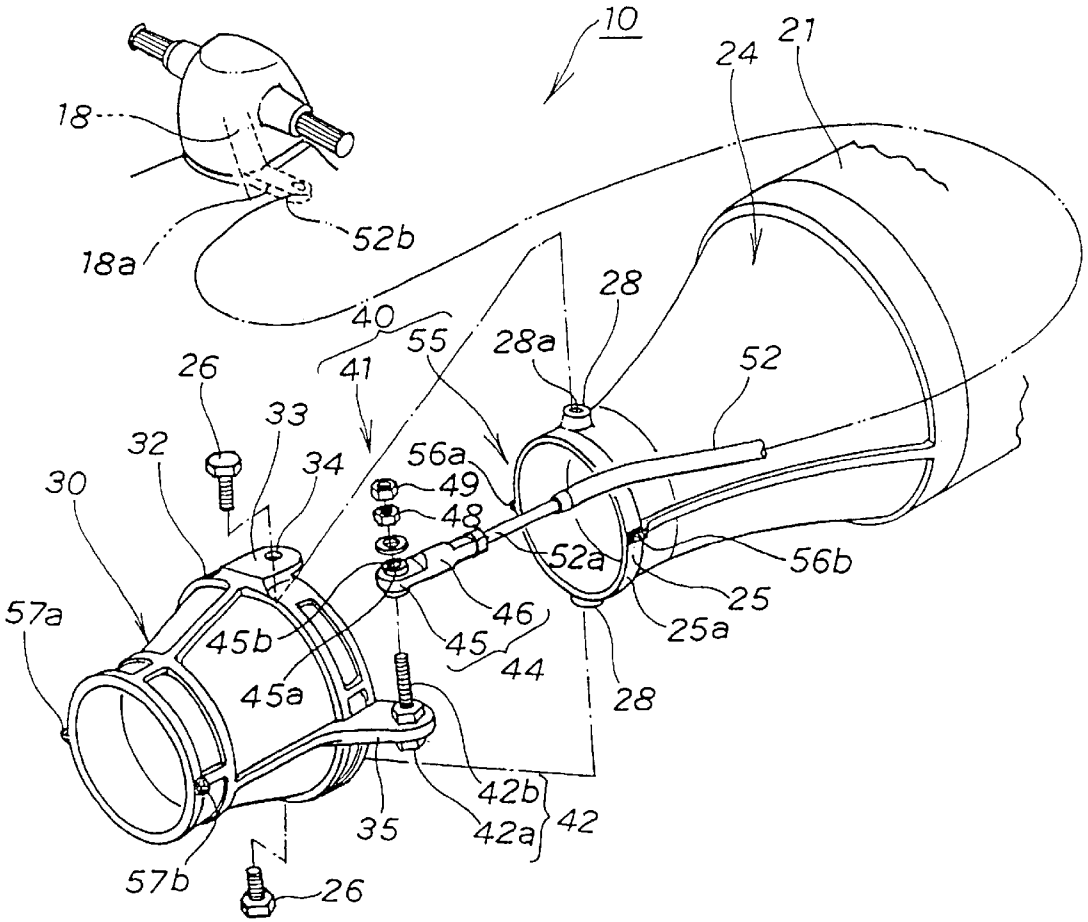
FIG. 2 is an exploded perspective view showing the steering nozzle angle adjusting mechanism for the jet propulsion watercraft according to the present invention.

FIG. 2 is an exploded perspective view of the steering nozzle angle adjusting mechanism for the jet propulsion watercraft according to the present invention.

A jet nozzle 24 is a truncated cone shaped tubular body gradually reduced in diameter toward the rear side, and is a member constituting a rear end portion of the housing 21. The jet nozzle 24 is a member in which upper and lower bosses 28, 28 are provided at the outer circumference 25*a* of an outlet 25, and the upper and lower bosses 28, 28 are provided with female screws 28*a*, 28*a* (only the upper side one is shown) for fitting.

The steering nozzle 30 is a truncated cone shaped tubular body gradually reduced in diameter toward the rear side, similarly to the jet nozzle 24, and has a structure in which flat portions 33, 33 (only the upper side one is shown) are provided respectively at upper and lower portions on the side of an inlet 32, the upper and lower flat portions 33, 33 are respectively provided with fitting holes 34, 34, and an arm 35 is provided on a right side wall on the side of the inlet 32.

In fitting the steering nozzle 30 to the jet nozzle 24, the inlet 32 side of the steering nozzle 30 is fitted over the outlet 25 side of the jet nozzle 24, the upper and lower support shafts 26, 26 are inserted respectively into the fitting holes 34, 34 of the upper and lower flat portions 33, 33, and the support shafts 26, 26 thus inserted are screw-connected to the upper and lower female screws 28, 28 of the jet nozzle 24. By this, the steering nozzle 30 can be fitted so that it can be swung in the left and right directions.

The steering nozzle angle adjusting mechanism 40 comprises a connecting and adjusting means 41 for connecting the operational cable 52 to the steering nozzle 30 and adjusting the fitting angle of the steering nozzle 30, and a steering nozzle positioning means 55 for disposing the steering nozzle 30 at a normal angle.

The connecting and adjusting means 41 comprises, as main members, a fitting rod 42 to be fixed to the arm 35 of the steering nozzle 30, and a joint 44 provided with a head portion 45 which can be fitted over the fitting rod 42 and with a neck portion 46 which can be screw-connected to the operational cable 52.

The steering nozzle positioning means 55 comprises left and right first positioning projections (positioning projections) 56*a*, 56*b* provided respectively on the left and right sides of the outlet 25 side of the jet nozzle 24, and left and right second positioning projections (positioning projections) 57*a*, 57*b* provided respectively on the left and right sides of the outlet 31 side of the steering nozzle 30.

The arm 35 of the steering nozzle 30 is a member which is provided at a right side wall of the steering nozzle 30, and is provided at its tip end with a threaded hole 35*a* (shown in FIG. 3) for screw connection of the fitting rod 42.

The fitting rod 42 is a member which is provided with a head portion 42*a* at a lower end portion thereof, and is threaded from the upper end of a rod portion 42*b* to the head portion 42*a*.

The joint 44 comprises the head portion 45 and the neck portion 46. The head portion 45 is a member which comprises a spherical body 45*a* turnably provided at a central portion, and the spherical body 45*a* is provided with a through-hole 45*b*.

The neck portion 46 formed as one body with the head portion 45 is a member which is provided with a female screw 46*a* (shown in FIG. 3) at its tip end, for screw-connecting the rear end 52*a* of the operational cable 52 to the female screw 46*a*.

The operational cable 52 is a member whose tip end 52*b* is connected to an arm 18*a* of the steering handle 18 and whose rear end 52*a* is connected to the neck portion 46 of the joint 44 by screw connection.

Thus, with the operational cable 52 connected to the steering nozzle 30 through the connecting and adjusting means 41, the steering nozzle 30 can be swung to the left and right directions with the upper and lower support shafts 26, 26 as a center by operating the operational cable 52 by the steering handle 18.

Figure 3:
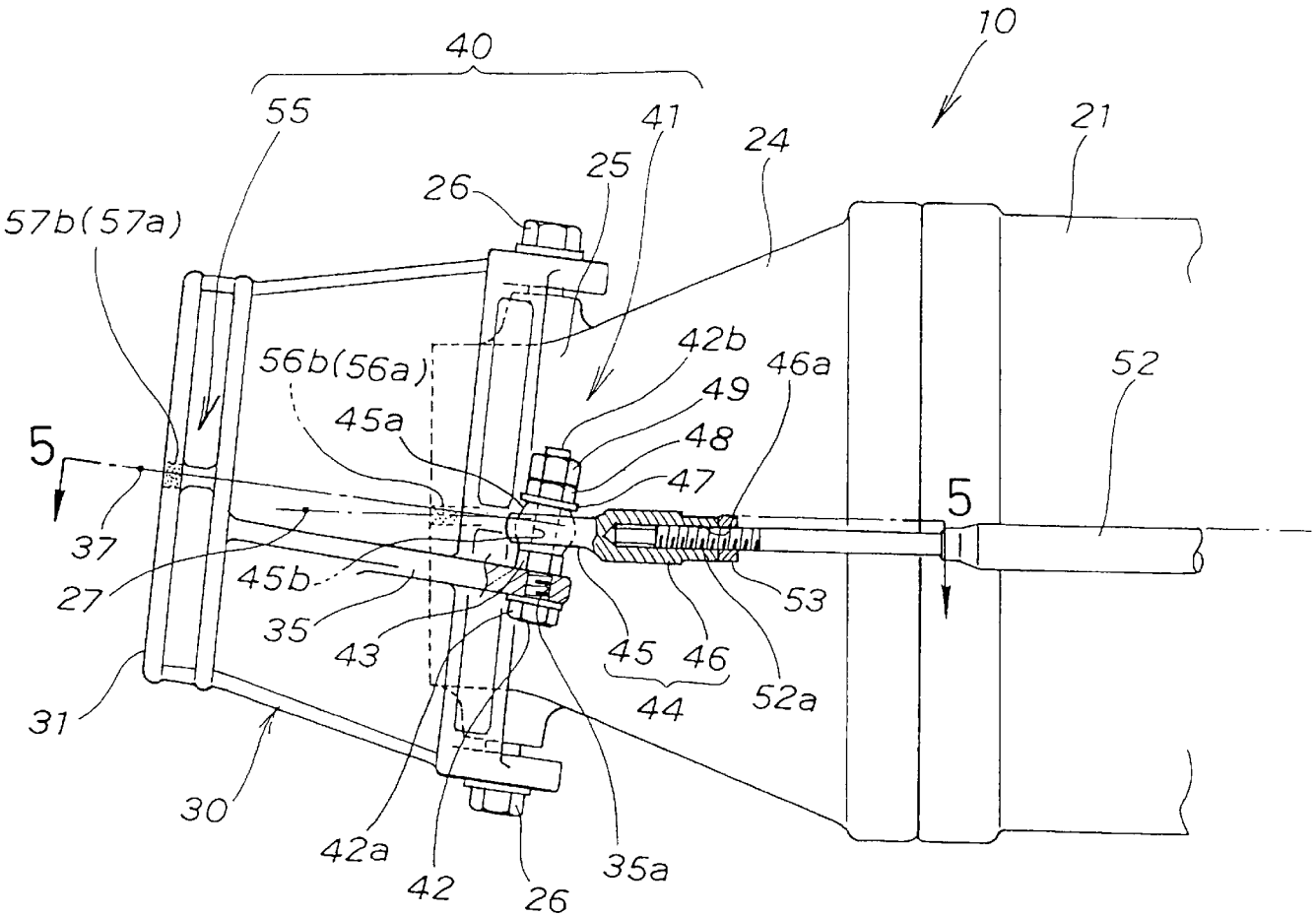
FIG. 3 is a side view showing the steering nozzle angle adjusting mechanism for the jet propulsion watercraft according to the present invention.

FIG. 3 is a side view showing the steering nozzle angle adjusting mechanism for the jet propulsion watercraft according to the present invention.

Figure 6A:
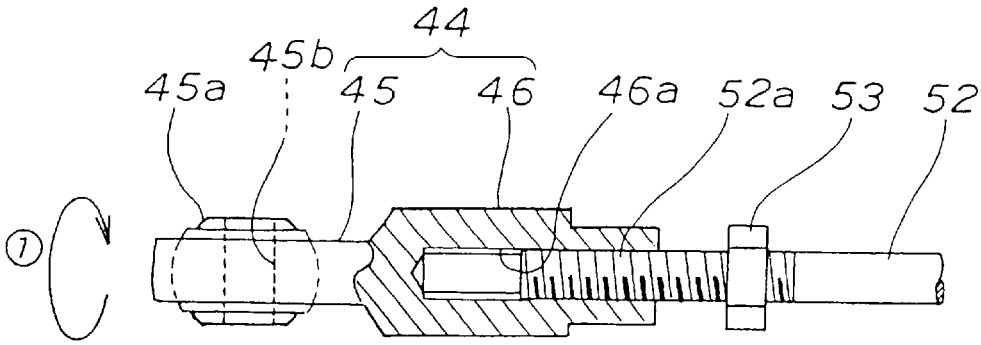
FIGS. 6(*a*) and 6(*b*) are first action illustrations of a connecting and adjusting means constituting the steering nozzle angle adjusting mechanism for the jet propulsion watercraft according to the present invention.
Figure 6B:
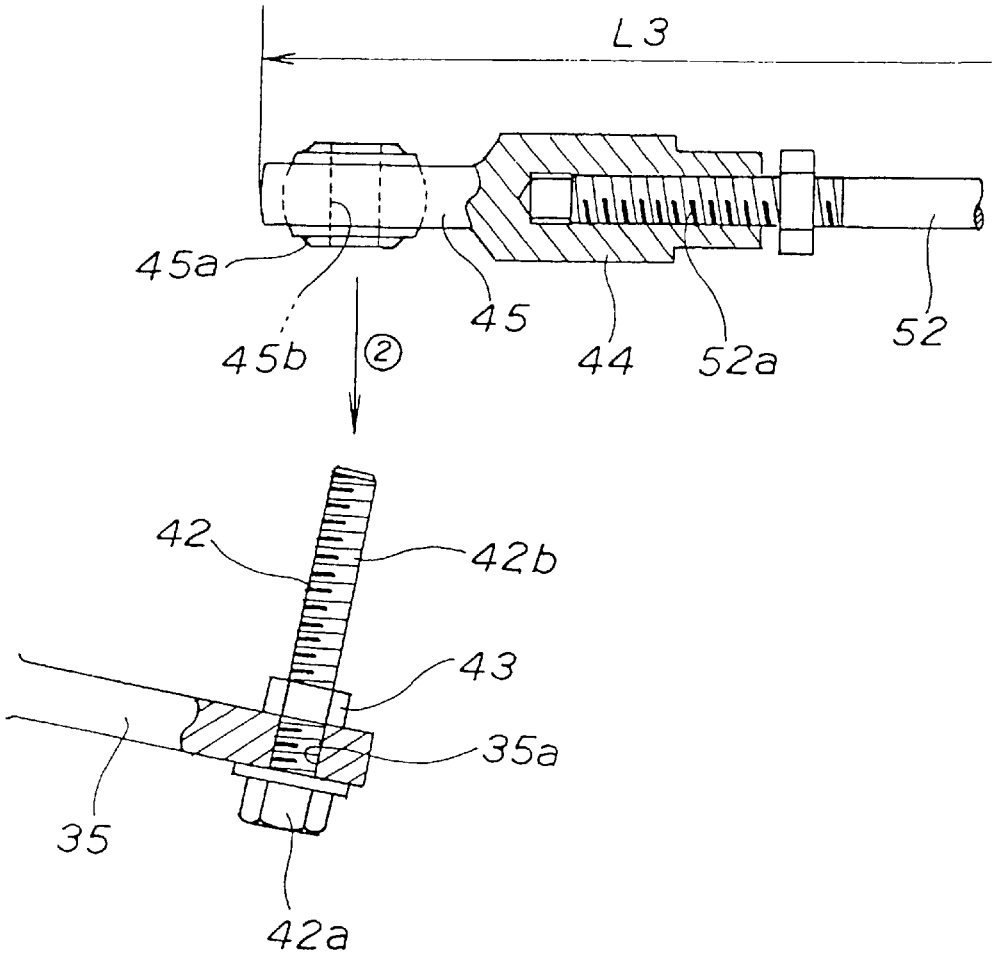

The connecting and adjusting means 41 has a construction in which the fitting rod 42 is fitted on the side of the steering nozzle 30, the joint 44 is turnably supported on the fitting rod 42 so that the joint 44 can be fitted over and detached from the fitting rod 42, the operational cable 52 can be connected to the joint 44, and the cable length L3 (shown in FIG. 6(*b*)) can be adjusted at the time when the operational cable 52 is connected to the joint 44.

The connecting and adjusting means 41 is a mechanism in which the screw portion at the rear end 52*a* of the operational cable 52 is screw-connected to the female screw 46*a* formed at the neck portion 46 of the joint 44 with the fitting rod 42 is screwed into the threaded hole 35*a* of the arm 35 of the steering nozzle 30. A lock nut 43 is screwed from the tip end (upper end) side of the fitting rod 42 to clamp the arm 35 between the head portion 42*a* of the fitting rod 42 and the lock nut 43, thereby fixing the fitting rod 42 to the arm 35. The through-hole 45*b* of the joint 44 is fitted over the fitting rod 42 with a washer 47 fitted over the joint 44 and a nut 48 screwed onto the washer 47, whereby the joint 44 is swingably fitted to the fitting rod 42 by the nut 48 and the lock nut 43. A lock nut 49 is screwed onto the nut 48 to thereby prevent the nut 48 from loosening. A lock nut 53 is fastened to the neck portion 46 of the joint 44 to thereby connect the operational cable 52 to the steering nozzle 30.

With the spherical body 45*a* turnably provided at the head portion 45 of the joint 44 and the spherical body 45*a* fitted to the fitting rod 42, the neck portion 46 can be swung in any direction relative to the spherical body 45*a* in the condition where the joint 44 is fitted to the fitting rod 42.

The steering nozzle positioning means 55 has a structure in which the left and right first positioning projections 56*a*, 56*b* are disposed on left and right outside surfaces on the outlet 25 side of the jet nozzle 24 and on an axis 27. The left and right second positioning projections 57*a*, 57*b* are disposed on left and right outside surfaces on the outlet 31 side of the steering nozzle 30 and on an axis 37.

Figure 4:
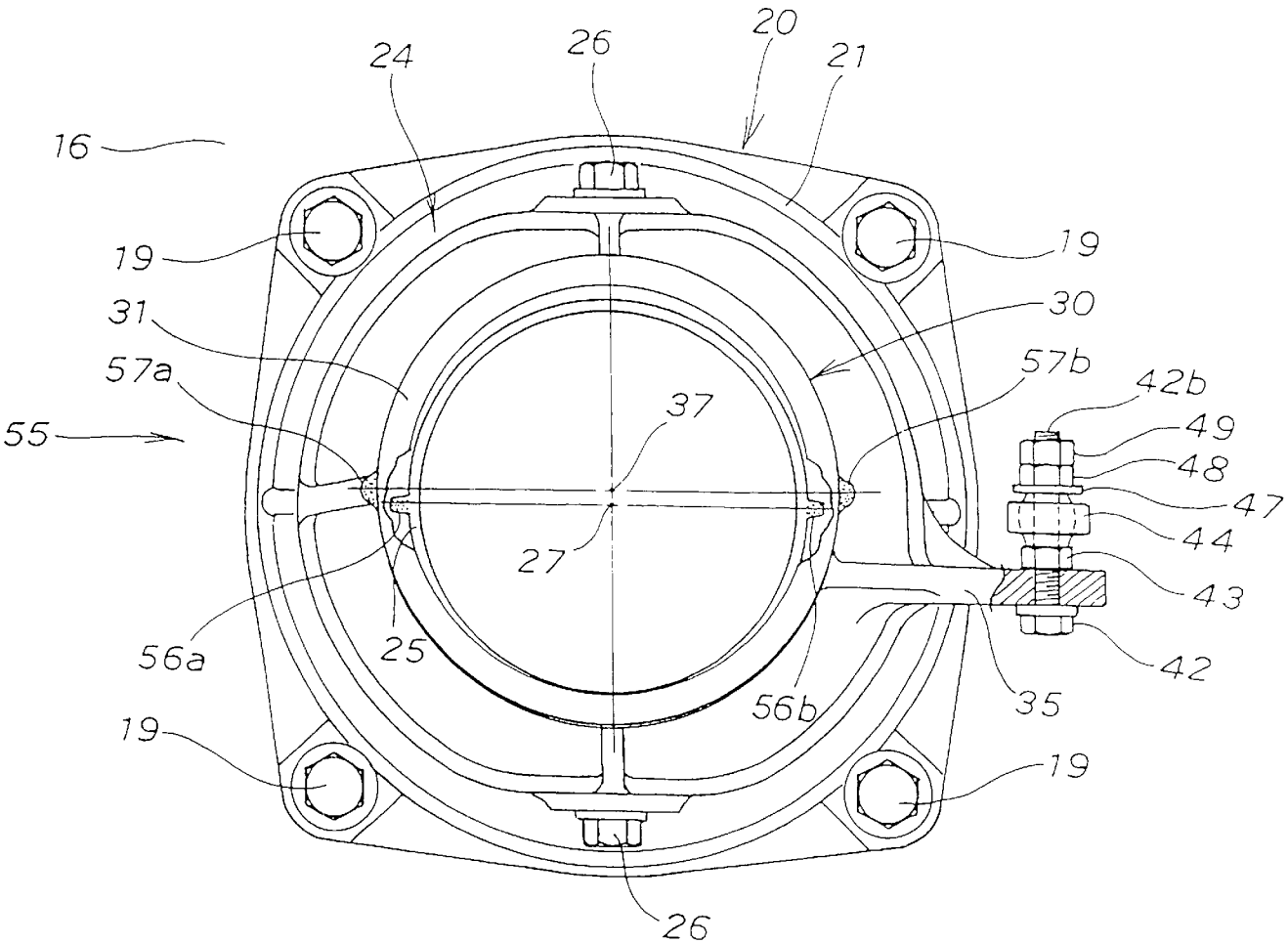
FIG. 4 is a rear view showing the steering nozzle angle adjusting mechanism for the jet propulsion watercraft according to the present invention.

FIG. 4 is a rear view showing the steering nozzle angle adjusting mechanism for the jet propulsion watercraft according to the present invention illustrating the condition where the housing 21 of the jet propeller 20 is fitted to the jet propeller chamber 16 by bolts 19 . . . ( . . . represents plurality).

FIG. 4 shows the condition where the steering nozzle 30 is fitted, swingably in the left-right direction, to the jet nozzle 24 constituting a rear portion of the housing 21 through the upper and lower support shafts 26, 26. The fitting rod 42 is fixed to the arm 35 of the steering nozzle 30 with the joint 44 fitted to the fitting rod 42.

In addition, the steering nozzle positioning means 55 comprises the left and right first positioning projections 56*a*,

56*b* at the outlet 25 of the jet nozzle 24, and the left and right second positioning projections 57*a*, 57*b* at the outlet 31 of the steering nozzle 30, on the left and right sides (both sides) of the upper and lower support shafts 26, 26 for swingably supporting the steering nozzle 30 on the jet nozzle 24.

Figure 5:
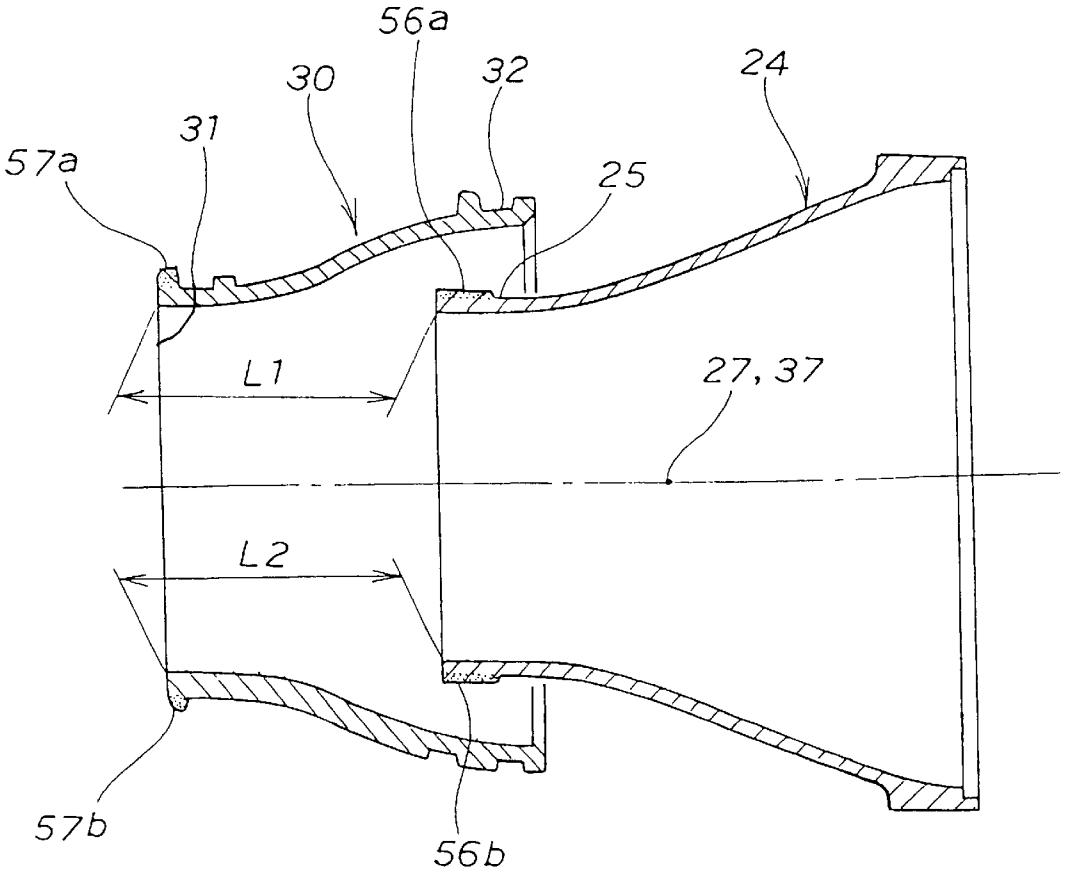
FIG. 5 is a sectional view taken along line 5—5 of FIG. 3.

FIG. 5 is a sectional view taken along line 5—5 of FIG. 3, and shows the condition where the left and right first positioning projections 56*a*, 56*b* are provided respectively on the left and right outside surfaces on the outlet 25 side of the jet nozzle 24, and the left and right second positioning projections 57*a*, 57*b* are provided, respectively, on the outlet 31 side of the steering nozzle 30.

In checking whether or not the steering nozzle 30 is disposed at the normal angle, the interval L1 between the left first positioning projection 56*a* and the left second positioning projection 57*a* is measured, and the interval L2 between the right first positioning projection 56*b* and the right second positioning projection 57*b* is measured.

If the interval L1 and the interval L2 are equal, it is judged that the steering nozzle 30 is disposed at the normal angle.

Here, as a method of checking whether or not the steering nozzle 30 is disposed at the normal angle, there may be contemplated, for example, a method of measuring the inclination of the steering nozzle 30 from the outer circumference side of the jet nozzle 24 and the steering nozzle 30. However, since various members are disposed in the surrounding of the outer circumferences of the jet nozzle 24 and the steering nozzle 30, it is difficult to measure the inclination of the steering nozzle 30 from the outer circumference side.

In view of this, the left and right first positioning projections 56*a*, 56*b* are provided respectively on the left and right outside surfaces on the outlet 25 side of the jet nozzle 24, whereas the left and right second positioning projections 57*a*, 57*b* are provided respectively on the outlet 31 side of the steering nozzle 30. The distance between the projections is measured from the inside of the steering nozzle 30.

The first positioning projections 56*a*, 56*b* provided on the outside surface of the jet nozzle 24 and the second positioning projections 57*a*, 57*b* provided on the outside surface of the steering nozzle 30 do not spoil the flow of jet water through the jet nozzle 24.

Next, the action or effects of the steering nozzle angle adjusting mechanism for the jet propulsion watercraft will be described based on FIGS. 6(*a*) to 8(*c*).

FIGS. 6(*a*) and 6(*b*) illustrate the first action of the connecting and adjusting means constituting the steering nozzle angle adjusting mechanism for the jet propulsion watercraft according to the present invention.

In FIG. 6(*a*), by rotating the joint 44 as indicated by arrow 1, the male screw at the rear end 52*a* of the operational cable 52 is screw-connected to the female screw 46*a* of the neck portion 46.

In FIG. 6(*b*), when the joint 44 is fitted to the rear end 52*a* of the operational cable 52, an adjustment is made to set the cable length L3 to a predetermined length.

In this condition, the through-hole 45*b* of the spherical body 45*a* is fitted over the rod portion 42*b* of the fitting rod 42 as indicated by arrow 2.

The fitting rod 42 is a member fixed to the arm 35 by fastening the lock nut 43 to the rod portion 42*b* after screwing the fitting rod 42 into the threaded hole 35*a* of the arm 35.

Figure 7A:
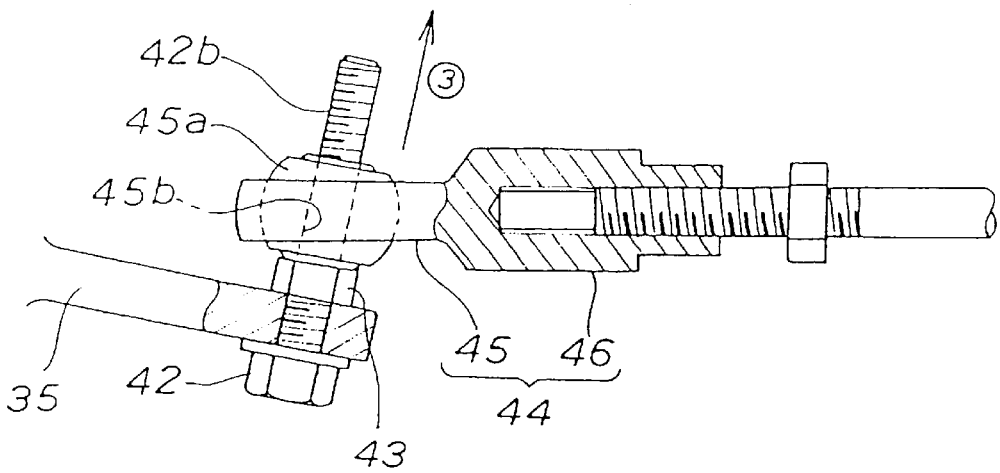
FIGS. 7(*a*) and 7(*b*) are second action illustrations of the connecting and adjusting means constituting the steering nozzle angle adjusting mechanism for the jet propulsion watercraft according to the present invention.
Figure 7B:
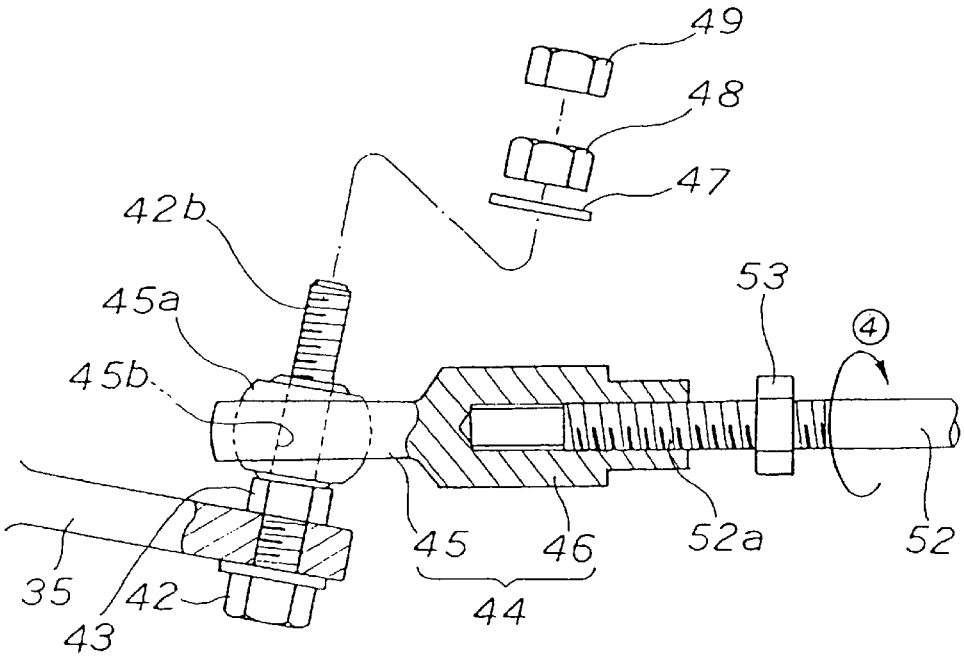

FIGS. 7(*a*) and 7(*b*) illustrate the second action of the connecting and adjusting means constituting the steering nozzle angle adjusting mechanism for the jet propulsion watercraft according to the present invention.

In FIG. 7(*a*), in the condition where the through-hole 45*b* of the spherical body 45*a* is fitted over the rod portion 42*b* of the fitting rod 42, it is checked whether or not the steering nozzle 30 shown in FIG. 5 is disposed at the normal angle.

Incidentally, the method of checking whether or not the steering nozzle 30 is disposed at the normal angle will be described in detail referring to FIGS. 8(*a*) to 8(*c*).

When the steering nozzle 30 is not disposed at the normal angle, the joint 44 is detached from the fitting rod 42 as indicated by arrow 3, and the joint 44 is rotated relative to the operational cable 52 as shown in FIG. 6(*a*).

By this, the cable length L3 shown in FIG. 6(*b*) is readjusted, and the through-hole 45*b* of the spherical body 45*a* is again fitted over the rod portion 42*b* of the fitting rod 42 as indicated by arrow 2.

In FIG. 7(*b*), in the condition where the through-hole 45*b* of the spherical body 45*a* is fitted over the rod portion 42*b* of the fitting rod 42, it is again checked whether or not the steering nozzle 30 is disposed at the normal angle.

When the steering nozzle 30 is found disposed at the normal angle, the washer 47 is fitted over the rod portion 42*b* of the fitting rod 42 from the upper end, the nut 48 is fastened from the upper side of the washer 47, and the lock nut 49 is fastened from the upper side of the nut 48. By this, the joint 44 is fitted to the fitting rod 42.

Next, the lock nut 53 screw-connected to the rear end 52*a* of the operational cable 52 is brought into contact with the neck portion 46 of the joint 44 by rotating as indicated by arrow 4, whereby the joint 44 is locked relative to the operational cable 52.

By this, the operation of connecting the operational cable 52 to the steering nozzle 30 is completed.

As described above, the operational cable 52 can be tentatively fixed to the steering nozzle 30 by only erecting the fitting rod 42 on the steering nozzle 30 through the arm 35 and fitting the through-hole 45*b* of the joint 44 over the fitting rod 42.

By this, in the condition of tentative fixing where the through-hole 45*b* of the joint 44 is simply fitted over the fitting rod 42, it is possible to check whether or not the fitting angle of the steering nozzle 30 is normal. Therefore, even in the case where it is necessary to readjust the fitting angle of the steering nozzle 30, the joint 44 can be easily detached from the fitting rod 42.

Therefore, adjustment of the fitting angle of the steering nozzle 30 can be easily carried out without requiring much labor.

Figure 8A:
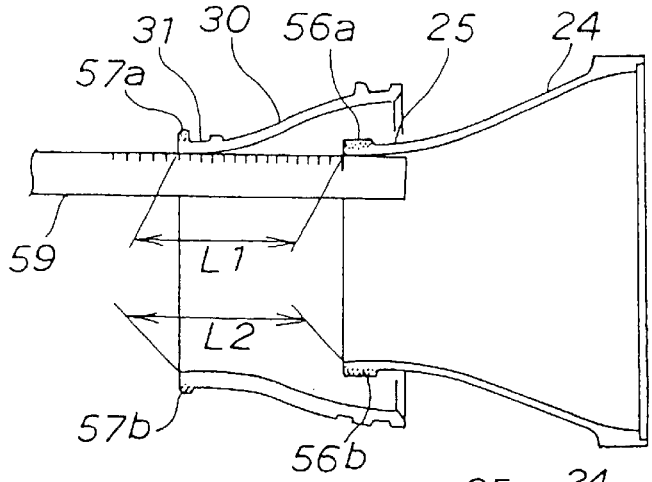
FIGS. 8(*a*), 8(*b*) and 8(*c*) are action illustrations of a steering nozzle positioning means constituting the steering nozzle angle adjusting mechanism for the jet propulsion watercraft according to the present invention.
Figure 8B:
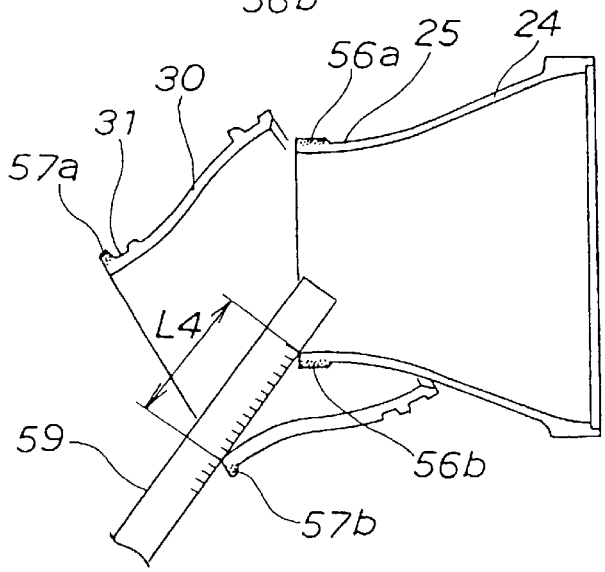
Figure 8C:
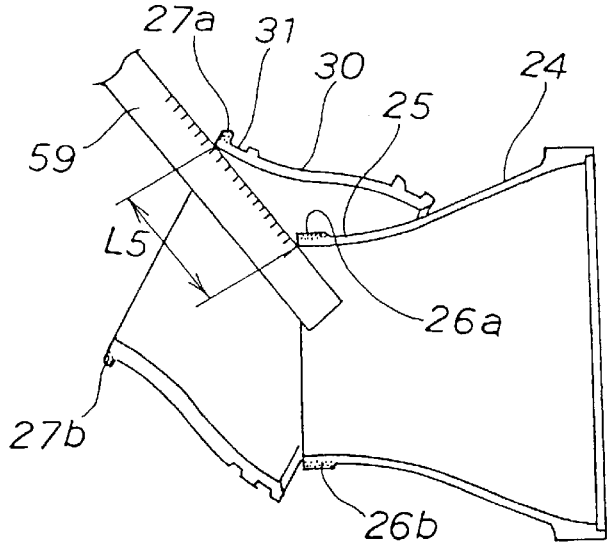
Figure 9:
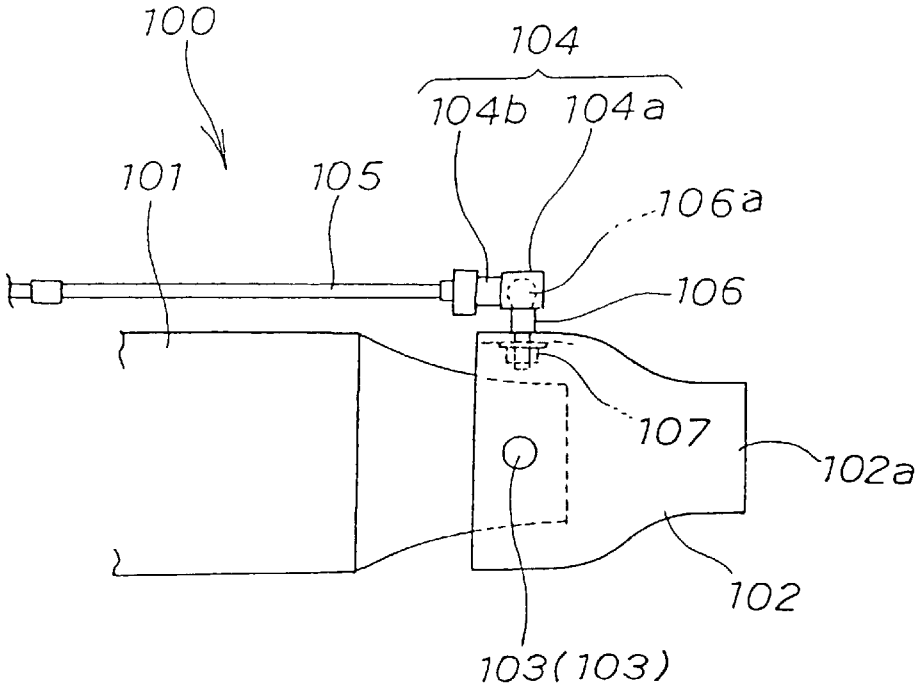
FIG. 9 BACKGROUND ART
FIG. 9 is a side view of a propulsion nozzle provided on a conventional jet propulsion watercraft.
Figure 10:
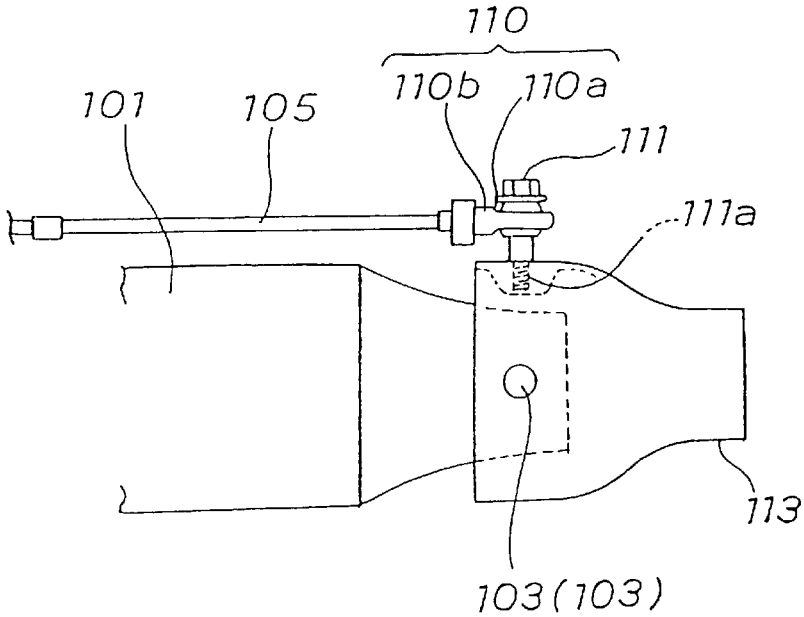
FIG. 10 BACKGROUND ART
FIG. 10 is a side view showing another joint for connecting a cable to a conventional propulsion nozzle.

FIGS. 8(*a*) to 8(*c*) illustrate the actions of the steering nozzle positioning means constituting the steering nozzle angle adjusting mechanism for the jet propulsion watercraft according to the present invention.

In FIG. 8(*a*), in the condition where the steering nozzle 30 is set straight, the interval L1 between the left first positioning projection 56*a* and the left second positioning projection 57*a* is measured with a scale 59, and the interval L2 between the right first positioning projection 56*b* and the right second positioning projection 57*b* is measured with the scale 59.

If the interval L1 and the interval L2 are equal, it is judged that the steering nozzle 30 is disposed at the normal angle.

In FIG. 8(*b*), in the condition where the steering nozzle 30 is inclined to the right direction, the interval L4 between the right first positioning projection 56*b* and the right second positioning projection 57*b* is measured with the scale 59.

In FIG. 8(*c*), in the condition where the steering nozzle 30 is inclined to the left direction, the interval L5 between the right first positioning projection 56*a* and the right second positioning projection 57*a* is measured with the scale 59.

If the interval L4 and the interval L5 are equal, it is judged that the steering nozzle 30 is disposed at the normal angle.

Thus, with the jet nozzle 24 and the steering nozzle 30 each being provided with the first and second positioning projections 56*a*, 56*b*, 57*a*, 57*b*, the distance between the positioning projections 56*a* and 57*a* and the distance between the positioning projections 56*b* and 57*b* can be measured by using the projections 56*a*, 56*b* on the jet nozzle 24 and the projections 57*a*, 57*b* on the steering nozzle 30 as marks.

Based on the measured values, the steering nozzle 30 can be disposed at the normal angle without requiring a great deal of skill, so that an adjustment of the angle of the steering nozzle 30 can be easily carried out without much labor.

While the steering nozzle positioning means 55 has been described by taking the first positioning projections 56*a*, 56*b* and the second positioning projections 57*a*, 57*b* as examples in the above embodiment, this structure is not limitative. Namely, the same effect can be obtained by adopting first positioning recesses and second positioning recessed in place of the first positioning projections 56*a*, 56*b* and the second positioning projections 57*a*, 57*b*.

In addition, while an example of measuring the intervals between the first positioning projections provided on the jet nozzle 24 and the second positioning projections provided on the steering nozzle 30 with the scale 59 has been described as an example in the above embodiment, this is not limitative. Namely, measurement with other measuring instrument is possible.

Further, the means for fitting the joint 44 to the fitting rod 42 and the means for fitting the fitting rod 42 to the arm 35 are not limited to those described in the above embodiment. For example, while an example of fixing the joint 44 by the washer 47, the nut 48 and the lock nut 49 after fitting the joint 44 over the fitting rod 42 has been described in the above embodiment, it is possible, for example, not to use the washer 47.

Furthermore, while an example of threading the entire part of the rod portion 42*b* of the fitting rod 42 has been described, the portion over which the joint 44 is fitted need not be threaded.

In addition, while an example of screw-connecting the fitting rod 42 into the threaded hole 35*a* of the arm 35 has been described, it is possible, for example, to replace the threaded hole 35*a* with a though-hole and to insert the fitting rod 42 into the through-hole of the arm 35.

Besides, while an example of screw-connecting the neck portion 46 of the joint 44 to the operational cable 52 has been described, the connection between the neck portion 46 of the joint 44 and the operational cable 52 is not limited to the screw connection. In short, it suffices that the neck portion 46 of the joint 44 can be connected to the operational cable 52 so that the cable length L3 upon connection can be adjusted.

The present invention constituted as above displays the following effects. The fitting rod is fitted to the steering nozzle side, and the joint can be turnably supported on the fitting rod so that the joint can be fitted over and detached from the fitting rod, whereby the operational cable can be tentatively fixed to the steering nozzle by only fitting the joint over the fitting rod. In this way, whether or not the angle of the steering nozzle is normal can be checked in the condition of tentative fixing where the joint is simply fitted over the fitting rod.

Therefore, even in the case where it is necessary to readjust the angle of the steering nozzle, the joint can be easily detached from the fitting rod. Therefore, adjustment of the angle of the steering nozzle can be easily performed without much labor.

The present invention provides a jet nozzle and the steering nozzle that are each provided with positioning projections or positioning recesses for the steering nozzle. By this, for example, by using the projections on the steering nozzle and the projections on the jet nozzle as marks and measuring the distances between the projections, it is possible to dispose the steering nozzle at the normal angle without requiring a great deal of skill.

Therefore, adjustment of the angle of the steering nozzle can be easily carried out without much labor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A steering nozzle angle adjusting mechanism for a jet propulsion watercraft comprising:

a jet nozzle for jetting water from the watercraft, said jet nozzle being provided at a stern portion of the watercraft;

a steering nozzle being operatively connected to said jet nozzle, said steering nozzle being movable left and right relative to said jet nozzle by use of an operational cable to change the direction of a jet of water from said jet nozzle for thereby steering the watercraft;

at least one pair of positioning projections and at least one pair of positioning recesses positioned on said jet nozzle and said steering nozzle on both sides of a support shaft for swingably supporting said steering nozzle on said jet nozzle and said at least one pair of positioning projections and at least one pair of positioning recesses being disposed symmetrically with respect to an axis line of the support shaft.

2. The steering nozzle angle adjusting mechanism for a jet propulsion watercraft according to claim 1, wherein said support shaft retains said steering nozzle relative to said jet nozzle for swinging movement of said steering nozzle relative to said jet nozzle.

3. The steering nozzle angle adjusting mechanism for a jet propulsion watercraft according to claim 1, wherein when said steering nozzle is aligned relative to said jet nozzle, a distance from a positioning projection disposed on said steering nozzle positioned on a first side of said support shaft to a positioning projection disposed on said jet nozzle positioned on the first side of said support shaft is equal to a distance from a positioning projection disposed on said steering nozzle positioned on a second side of said support shaft to a positioning projection disposed on said jet nozzle positioned on the second side of said support shaft.

4. The steering nozzle angle adjusting mechanism for a jet propulsion watercraft according to claim 1, wherein when said steering nozzle is at an angle relative to said jet nozzle, a distance from a positioning projection disposed on said steering nozzle positioned on a first side of said support shaft to a positioning projection disposed on said jet nozzle positioned on the first side of said support shaft is not equal to a distance from a positioning projection disposed on said steering nozzle positioned on a second side of said support shaft to a positioning projection disposed on said jet nozzle positioned on the second side of said support shaft.

5. The steering nozzle angle adjusting mechanism for a jet propulsion watercraft according to claim 1, wherein the at least one positioning projection is disposed on an outer surface of said jet nozzle and on an outer surface of said steering nozzle.

* * * * *